US005190166A

United States Patent [19]

Vilsbøll

[11] Patent Number: 5,190,166

[45] Date of Patent: Mar. 2, 1993

[54] STAND OR SEPARATION, ESPECIALLY A BOOK-END

[76] Inventor: Niels Vilsbøll, Bakken 9, Ydby, DK-7760 Hurup Thy, Denmark

[21] Appl. No.: 768,657

[22] PCT Filed: Apr. 11, 1990

[86] PCT No.: PCT/DK90/00094

§ 371 Date: Oct. 11, 1991

§ 102(e) Date: Oct. 11, 1991

[87] PCT Pub. No.: WO90/11706

PCT Pub. Date: Oct. 18, 1990

[30] Foreign Application Priority Data

Apr. 12, 1989 [DK] Denmark ..... 1751/89

[51] Int. Cl.[5] ..... A47F 7/00

[52] U.S. Cl. ..... 211/43; 211/184; 211/11

[58] Field of Search ..... 211/43, 184, 11, 42

[56] References Cited

U.S. PATENT DOCUMENTS 388,674 8/1888 Harrington ..... 211/43

3,285,429 11/1966 Propst ..... 211/43

FOREIGN PATENT DOCUMENTS 70528 1/1950 Denmark ..... 211/43

109121 11/1943 Sweden ..... 211/43

*Primary Examiner*—Alvin C. Chin-Shue

*Assistant Examiner*—Sarah A. Lechok

*Attorney, Agent, or Firm*—Antonelli, Terry, Stout & Kraus

[57] ABSTRACT

A support or separation, especially a book-end consists of a resilient element (1) and a support element (2). The support or the separation achieves its function by, that the branch (5) of the resilient element, which engages the underside of the shelf and the upper branch (3), which the support element slides upon, is wedge shape, thereby one can adapt the support or separation to the thickness of the shelf by displacing the support element on the resilient element. Hereby is obtained a surface pressure between the parts, which results in, that the support is self-locking, and hereby is the function of the support or the separation obtained. The two holes in the support element are placed so, that by turning the support element upside down variations in adaption to the doubled thickness of the shelf can be obtained.

10 Claims, 2 Drawing Sheets

STAND OR SEPARATION, ESPECIALLY A BOOK-END

FIELD OF THE INVENTION

The present invention relates to a stand or separation, especially a book end to be used on book shelves, shelves, desks and the like furniture having one or more horizontal plate elements, for example, shelves and to a construction for gripping the shelf so as to enable the respective shelves to be fixed thereon by sliding a support element in relation to a resilient element.

BACKGROUND OF THE INVENTION

In, for example, Swedish Patent 109,121 a book-end is proposed wherein the fixation to the shelf takes place by sliding two elements relatively to each other. A support part and the part engaging the underside of the shelf are made as a unit, with a wedge action arising by the lower part of the support being provided with a wedge track which is inclined towards the shelf. The book-end is comparatively complicated, as a track has to be made both in the fixed and in the sliding part. Moreover the adaption of the book-end to various shelf thicknesses is limited due to the wedge-track rendering no alternative variations.

SUMMARY OF THE INVENTION

The object of the present invention is to provide a stand or separation of a modern design, with a wide range of adaption to different thicknesses of shelves, and, at the same time, having a simple construction and being especially functional, as without screws and small springs it can be fastened on a shelf.

This is achieved by a stand or separation according to the invention, characterized in that the support element rests against the shelf with a support area and can be locked thereto by the resilient element, which has a branch parallel to the support area of the support element, which branch is resiliently connected to another branch, which is inclined in relation to the first branch, such that the together from a wedge, and is slidably connected to the support element. By displacement of the support element the distance to the resilient element, which engages the opposite side of the shelf, can be changed, causing a clamping force on the shelf between the supporting element and the resilient element. This results in an area pressure between one side of the shelf and the support element and an area pressure between the resilient element and the opposite side of the shelf.

The attachment to various shelves of different thicknesses is achieved by more or less displacing the support element on the resilient element. The wedge angle of the resilient element and the rigidity is chosen such that the support element is self locking by means of friction, which contributes to the simplicity of the book-end.

By placing holes for the resilient element in the support element at different distances, a greater adaptability for different thickness of shelves is achieved by turning the support element.

In a further embodiment of the book-end according to the invention the support element can be made with more sets of holes or tracks (depending on whether the support element is solid) and thereby having wide-range adaptability.

Preferably the lower branch of the resilient element is inclined slightly upwardly towards the engaging area of the support element, such that there, by tightening of the stand or separation around a shelf, is caused a pretension in the lower branch, which branch initially engages the shelf with its outer end a distance along the shelf, and, thereafter, in its entirety is pulled upwardly against the shelf.

BRIEF DESCRIPTION OF THE DRAWINGS

The invention shall be described in more detail in the following description with reference to the accompanying drawing, wherein.

DETAILED DESCRIPTION

Figure 1:
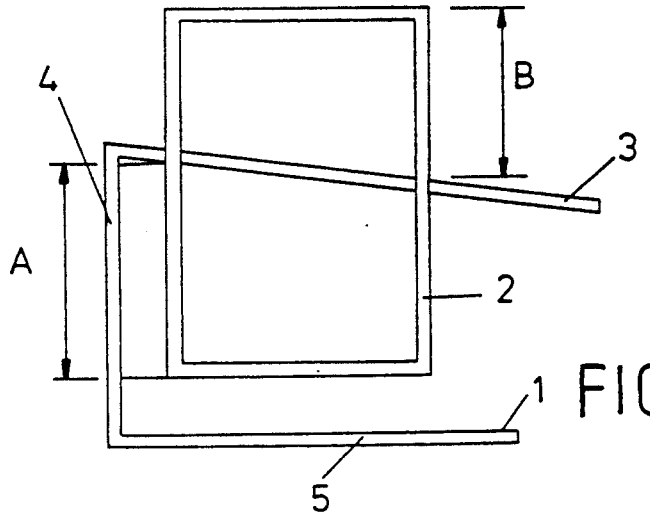
FIG. 1 is a schematic side view of an embodiment of a book-end according to the invention.
Figure 2:
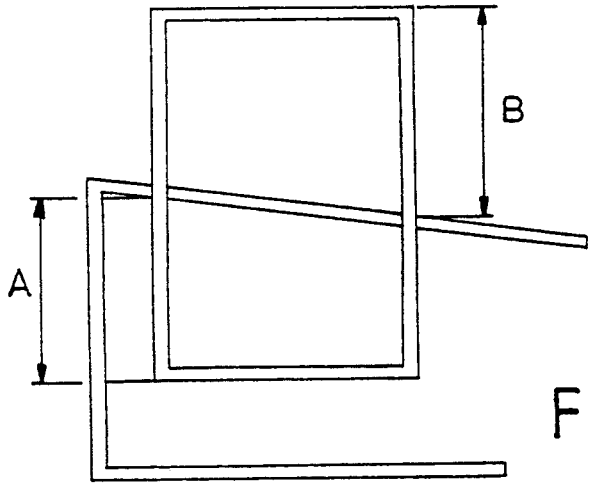
FIG. 2 is a side view of the book-end of FIG. 1 with the support element turned 180°.
Figure 3:
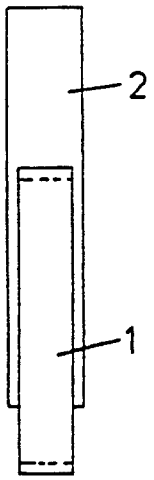
FIG. 3 is a front view of the book-end of FIG. 1.
Figure 4:
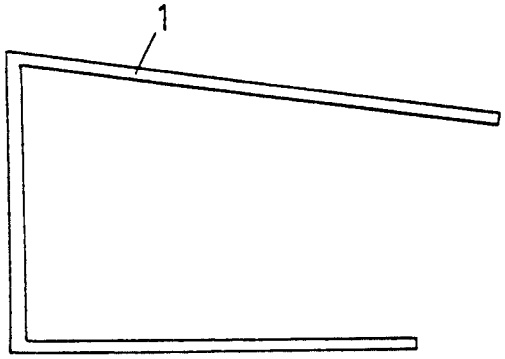
FIG. 4 is a side view of the resilient element for the book-end of the present invention.

The embodiment of the book-end shown in FIGS. 1 to 3 comprises a resilient element 1 and a support element 2. The resilient element 1 has a rigidity, such that it forms the necessary area pressure on the support element 2. The resilient element I has a rectangular cross section of such width, such that together with the width of the support element 2, the resilient element 1 provides a stable book-end at great loads. A lower branch 5 of the resilient element, which engages the under side of the shelf, (not shown) and the upper branch 3, which the support element 2 is sliding on, is wedge shaped having an angle which secures self-locking of the support element 2 even on very smooth surfaces for the resilient element 1, support element 2 and shelf. By the embodiment is chosen a shape of the resilient element 1 tapering towards the shelf, because at the time of placing the support element this is displaced by being pushed along the shelf, whereby it is achieved that the front 4 of the resilient element 1 is fixed against the front edge of the shelf. The book-end could therefore be placed using one hand only.

Figure 5:
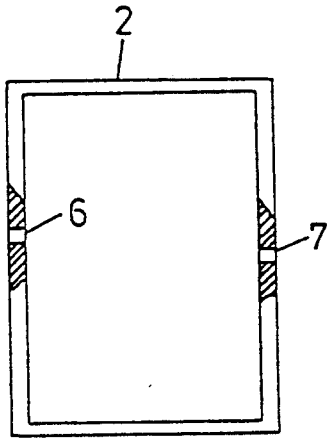
FIG. 5 is a partial cross-sectional view of the support element of FIG. 1.

Holes or openings 6 and 7 (FIG. 5) are provided in the support element 2 at distances A, B (FIGS. 1, 2) selected so as to facilitate adaption to twice the shelf thickness by turning the support element 180°.

Although the invention is especially considered to be used as a book-end, it is apparent that it can be used for other purposes than supporting books. Generally it can be used as support or separation on shelves and similar furniture, e.g. on shelves used in stores and in warehouses.

The stand or separation is mainly described as standing in an upright position on the shelves, however, it is also possible to hang in a downward direction and serve as support or separation for a shelf right below.

Figure 6:
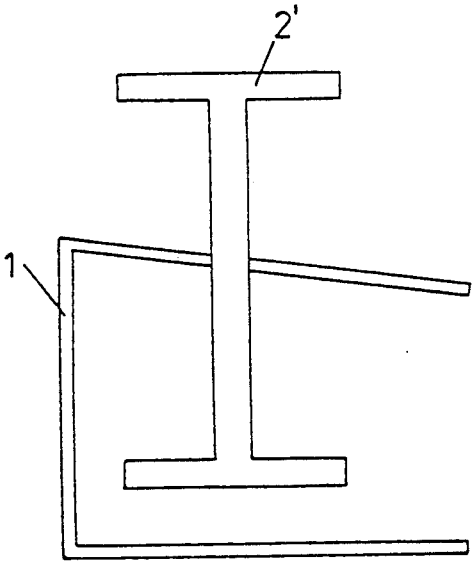
FIG. 6 is a schematic side view of another embodiment of a book-end of the present invention with an I-shaped support element.
Figure 7:
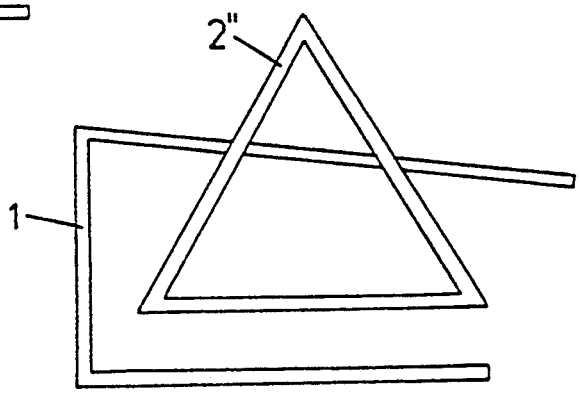
FIG. 7 is a schematic side view of yet another embodiment of a book-end of the present invention with a triangular-shaped support element.

Alternatively, as shown in FIGS. 6 and 7 a support element and a resilient element can have different shapes and may be fashioned of different material and, for example, the resilient element, e.g., can be circular or rectangular and the support element may, for example, be a triangular-shaped or an I-shaped support element 2'' support element 2' and may be either hollow or solid. Materials for the stand or separation may, for example, be steel, aluminum, wood or plastic. It is of course possible to mount, for example, rubber on the resilient element and the support element as bedding towards the shelf.

I claim:

1. Stand adapted to be used on a construction including at least one horizontally disposed plate element, the stand including a support element and a resilient element cooperable with the support element such that the stand is fixed on the at least one horizontal plate element by sliding the support element with respect to the resilient element, wherein the support element rests against the at least one horizontal plate element with a support area and is adapted to be locked thereto by the resilient element, the resilient element including a first branch disposed substantially parallel to the support area of the support element and a second branch resiliently connected to said first branch, said second branch is inclined with respect to the first branch such that the first and second branches form a wedge, and wherein said resilient element is slidably connected to the support element.

2. Stand according to claim 1, wherein the support element includes a plurality of support areas so as to enable the support element to be invertible.

3. Stand according to claim 1, wherein the support element includes at least one track for accommodating the resilient element.

4. Stand according to claim 1, wherein the entire support element is disposed between the at least one horizontal plate element and the second branch of the resilient element.

5. Stand according to claim 1, wherein the resilient element includes a plurality of branches for engagement with the support element.

6. Stand according to claim 1, wherein the first and second branches of the resilient element diverge from each other.

7. Stand according to claim 1, wherein the first and second branches of the resilient element diverge towards each other.

8. Stand according to claim 1, wherein the first branch of the resilient element is inclined slightly upwardly towards the support area of the support element.

9. Stand according to claim 1, wherein the resilient element is substantially U-shaped with the first and second branches respectively terminating at free ends, and wherein a free end of the second branch terminates at a position beyond a terminating end of said first branch.

10. Stand according to claim 1, wherein said stand is a bookend, and wherein the at least one horizontally disposed plate element is a book shelf or a desk.

* * * * *